US005441428A

United States Patent [19]

Hamai et al.

[11] Patent Number: 5,441,428

[45] Date of Patent: Aug. 15, 1995

[54] FEMALE TERMINAL PARTS

[75] Inventors: Tsuyoshi Hamai; Tamio Watanabe, both of Shizuoka, Japan

[73] Assignee: Yazaki Corporation, Japan

[21] Appl. No.: 314,382

[22] Filed: Sep. 28, 1994

[30] Foreign Application Priority Data

Sep. 28, 1993 [JP] Japan ..... 5-241164

[51] Int. Cl.[6] ..... H01R 15/10

[52] U.S. Cl. ..... 439/843; 439/852

[58] Field of Search ..... 439/843, 847, 825, 374, 439/380, 381, 844–846; 29/876

[56] References Cited

U.S. PATENT DOCUMENTS

| | | | |
|---|---|---|---|
| 4,319,796 | 3/1982 | Wiley | 439/374 |
| 4,717,356 | 1/1988 | Rahrig et al. | 439/852 |
| 5,226,842 | 7/1993 | Endo et al. | 439/843 |

FOREIGN PATENT DOCUMENTS

| | | | |
|---|---|---|---|
| 63-124385 | 5/1988 | Japan . | |
| 64-12383 | 1/1989 | Japan . | |
| 3291872 | 12/1991 | Japan | 439/825 |
| 6-215820 | 8/1994 | Japan . | |

*Primary Examiner*—Larry I. Schwartz
*Assistant Examiner*—Jill DeMello
*Attorney, Agent, or Firm*—Wigman, Cohen, Leitner & Myers

[57] ABSTRACT

Female terminal parts (25) comprises a terminal body (28) and a plate spring piece (9). The terminal body (28) is formed with a wire connecting portion (5) and an electric contact portion (3). The electric contact portion (3) is formed with a bottom plate portion (11); a pair of two opposing side plate portions (13, 15); and a pair of two half opposing top plate portions (27, 29). Further, a plate spring piece (9) is formed with a spring body (26) and a pair of lug portions (23) engaged with the lug engagement holes (21) formed in the two side plate portions, respectively when assembled with the terminal body (28). In particular, two opposing cut-off end surfaces (**27*b*, 29*b*) of the two half top plate portions are chamfered, and a distance (L2) between the two outer ends of the lug portions (23) is determined slightly smaller that another distance (L1) between the two chamfered surfaces (31, 33**) of the two half top plate portions.

5 Claims, 7 Drawing Sheets

FEMALE TERMINAL PARTS

BACKGROUND OF THE INVENTION

1. Field of the Invention

The present invention relates to female terminal parts mated with a male terminal of an electric connector, and more specifically to female terminal parts composed of a square cylindrical electric terminal body and a plate spring piece assembled with each other.

2. Description of the Related Art

FIG. 1 shows a conventional female terminal parts disclosed in Japanese Published Unexamined Utility Model Application No. 64-12383. The female terminal parts 1 are composed of a terminal body 7 formed with a square cylindrical electric contact portion 3 at one end thereof and a wire connecting portion 5 at the other end thereof, and a plate spring piece 9 assembled within the electric contact portion 3 separately. Further, the electric contact portion 3 of square cylindrical shape is formed with a bottom plate portion 11; two opposing side plate portions 13 and 15 bent upward at both sides of the bottom plate portion 11, respectively; and two opposing half top plate portions 17 and 19 further bend inward at both ends of the side plate portions 13 and 15, respectively. Further, two square-shaped lug engagement holes 21 are formed on the side plate portions 13 and 15 beginning from the bottom plate portion 11, respectively. On the other hand, the plate spring piece 9 is formed with two lug portions 23 on both sides thereof on one end thereof. Therefore, the female terminal parts 1 can be assembled by engaging the two lug portions 23 of the plate spring piece 9 with the two lug engagement holes 21 formed in the two side plate portions 13 and 15 of the electric contact portion 3 of the terminal body 7.

FIGS. 2A to 2J are views for assistance in explaining the manufacturing process of assembling the female terminal parts automatically in a mass production line. First, as shown in FIGS. 2A and 2B, the electric contact portion 3 is half bend; that is, the two side plate portions 13 and 15 are half (a predetermined angle) bent relative to the bottom plate portion 11 and further the two half top plate portions 17 and 19 are also half (another predetermined angle) bent relative to the two side plate portions 13 and 15, respectively. Under these conditions, as shown in FIGS. 2C and 2D, the plate spring piece 9 is inserted into an inner space of the electric contact portion 3 and mounted on the bottom plate portion 11 thereof. Further, as shown in FIGS. 2E, 2F, 2G and 2H, the two side plate portions 13 and 15 are further bent inward by additional two different steps to engage the two lug portions 23 of the plate spring piece 9 with the lug engagement holes 21 of electric contact portion 3. Lastly, as shown in FIGS. 2I and 2J, the two side plate portions 13 and 15 and the two half top plate portions 17 and 19 are further bent inward to complete the square-shaped electric contact portion 3. After the plate spring piece 9 has been assembled with the electric contact portion 3, the female terminal parts 1 thus assembled is mated with a male terminal parts (not shown).

In the above-mentioned automatic assembly process, as shown in FIG. 2D, it is necessary to determined a distance L1 of the opening space between the two half top plate portions 17 and 19 to be less than that L2 between two outer sides of the two lug portions 23 of the plate spring piece 9. Therefore, after the plate spring piece 9 has been mounted on the bottom plate portion 11, when an external force is applied to the electric contact piece 3 now having been assembled and thereby the electric contact piece 3 is vibrated, there exists a problem in that the mounted spring plate piece 9 is dislocated obliquely from the lug engagement holes 21 as shown in FIGS. 3A and 3B with the result that defective female terminal parts are inevitably produced in the automatic assembly line.

SUMMARY OF THE INVENTION

With these problem in mind, therefore, it is the object of the present invention to provide female terminal parts by which the plate spring piece can be assembled with the electric contact portion of the terminal body securely without dislocation of the lug portions from the lug engagement holes formed in the terminal body.

To achieve the above-mentioned object, the present invention provides female terminal parts (25), comprising: a terminal body (28) formed with: a wire connecting portion (5); and an electric contact portion (3), having: a bottom plate portion (11); a pair of two opposing side plate portions (13, 15) extending upward and further outward away from each other from both sides of the bottom plate portion, two lug engagement holes (21) being formed on both the side plate portions, respectively; and a pair of two half opposing top plate portions (27, 29) extending upward and further inward toward each other from both upper ends of the side plate portions, respectively, two opposing cut-off end surfaces (**27*b*, 29*b*) of the two half top plate portions being chambered; and a plate spring piece (9) formed with: a spring body (26); and a pair of lug portions (23) engaged with the lug engagement holes (21) formed in the two side plate portions, respectively when assembled with the terminal body (28), a distance (L2) between the two outer ends of the lug portions (23) being determined slightly smaller that another distance (L1) between the two chamfered surfaces (31, 33**) of the two half top plate portions.

Further, it is preferable that each of the chamfered surfaces (31, 33) is a slope surface beginning inward from an outer ridgeline (**27*e*, 29*e*) formed between an outside surface (27*d*, 29*d*) and the cut-off end surface (27*b*, 29*b*) of each of the top plate portions (27, 29). Further, it is preferable that each of the chamfered surfaces (31, 33) is located in a plane (S) extending from the outer ridgeline (27*e*, 29*e*) to an uppermost edge (21*a*) of the lug engagement hole (21**).

Further, the lug engagement holes (21) are formed on the two side plate portions (13, 15) beginning from the bottom plate portions, respectively. Further, the two opposing cut-off end surfaces (**27*b*, 29*b***) of the two half top plate portions are chambered by grinding processing before the female terminal parts are assembled with each other.

In the female terminal parts according to the present invention, since the two opposing cut-off end surfaces of the two half top plate portions are chamfered appropriately, it is possible to further bend the two side plate portions inward relative to the bottom plate portion, without reducing the opening dimension between the two half top plate portions, through which the plate spring piece is to be passed during assembly. In other words, since the engagement rate of the lug portions of the plate spring piece with the lug engagement holes formed in the terminal body can be increased, it is possible to assemble the plate spring piece with the electric contact portion of the terminal body more reliably, without causing dislocation of the plate spring piece from the terminal body in the automatic assembly line.

DETAILED DESCRIPTION OF THE EMBODIMENTS

An embodiment of the female terminal parts according to the present invention will be described hereinbelow with reference to the attached drawings.

Figure 5:
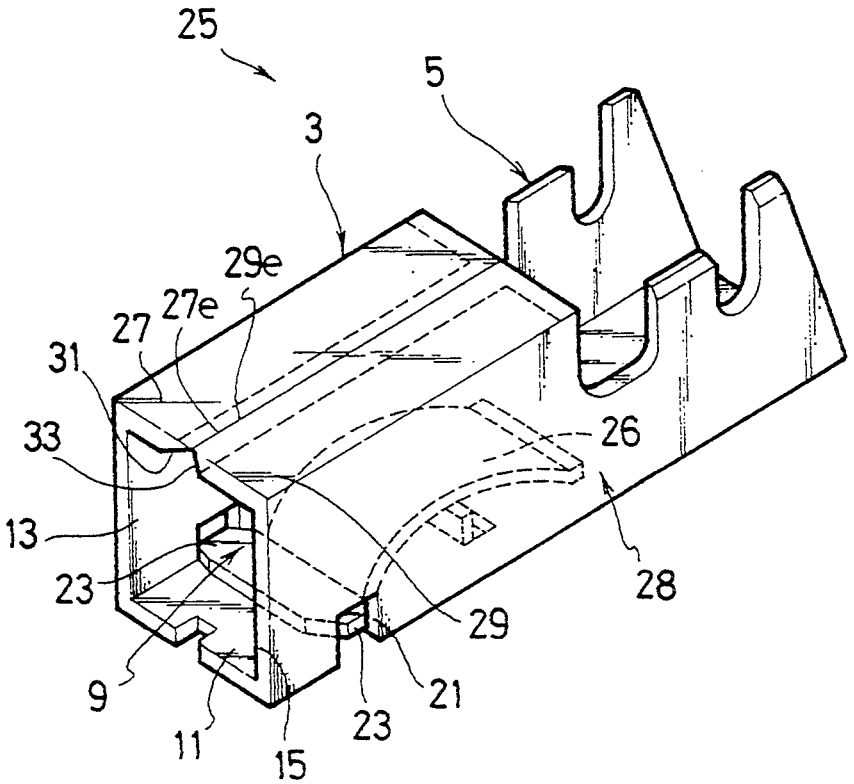
FIG. 5 is a perspective view showing the female terminal parts according to the present invention, in which the plate spring piece is assembled with the terminal body.

FIG. 5 shows the assembled female terminal parts 25, and FIG. 6 shows the same female terminal parts 25 connected to chain bands before assembled in an automatic assembly line. In FIG. 5, in the same way as with the case of the prior art female terminal parts 1 shown in FIG. 1, a female terminal part 25 of the present invention is composed of a terminal body 28 and a plate spring piece (9). The terminal body 28 is formed with a wire connecting portion 5 for clamping a wire at one end thereof, and a square cylindrical electric contact portion 3 mated with a male terminal at the other end thereof. Further, the electric contact portion 3 is formed into a square cylindrical shape, which is composed of a bottom plate portion 11, two side plate portions 13 and 15 bent upward on both sides of the bottom plate portion 11, and two half top plate portions 27 and 29 further bend inward on both upper ends of the side plate portions 13 and 15, respectively. On the other hand, the plate spring piece 9 is formed with a spring body 26 and a pair of lug portions 23 extending from both the sides of the spring body 26 on one end thereof. These lug portions 23 are engaged with two lug engagement holes 21 formed on both side plate portions 13 and 15 beginning from the bottom plate portion 11. That is, the female terminal parts 25 can be assembled by engaging the two lug portions 23 of the plate spring piece 9 with the two lug engagement holes 21 formed in the electric contact portion 3 of the terminal body 28.

Figure 4:
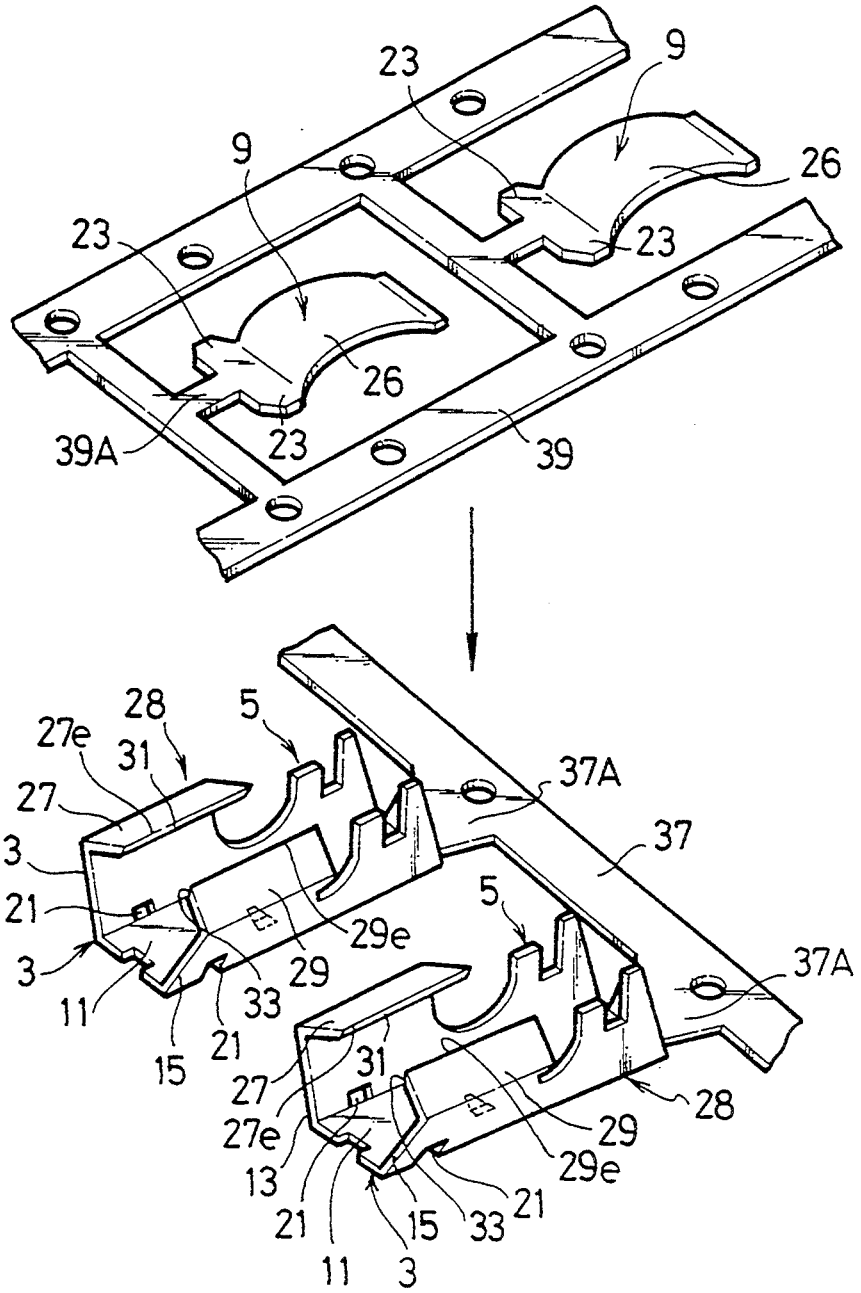
FIG. 4 is a perspective view showing the terminal bodies and the plate spring pieces of the female terminal parts according to the present invention, in which the terminal bodies and the plate spring pieces are both connected to a chain band, respectively.

On the other hand, in FIG. 4, the plate spring pieces 9 are connected to a chain band 39 and the terminal bodies 28 are connected to another chain band 37, both before assembled in an automatic assembly line. In particular, the terminal body 28 is half bent. This is because the plate spring piece 9 must be placed within the terminal body 28, before the terminal body 28 is bent into a completed terminal body shape. In more detail, in the terminal body 28, the two opposing side plate portions 13 and 15 extend upward and further outward away from each other from both sides of the bottom plate portion 11. Further, the two half opposing top plate portions 27 and 29 extend upward and further inward toward each other from both upper ends of the side plate portions 13 and 15, respectively.

Figure 1:
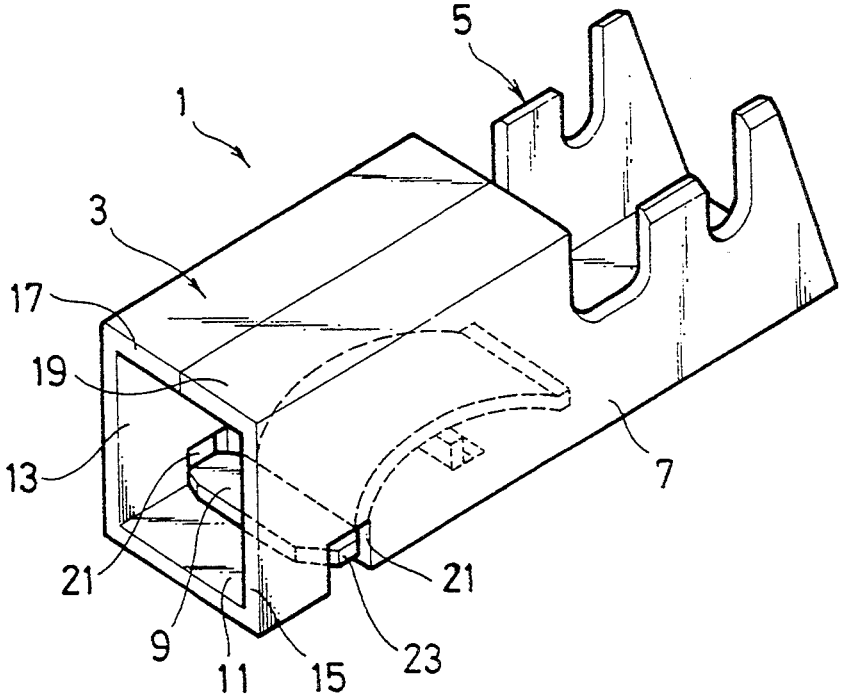
FIG. 1 PRIOR ART
FIG. 1 is a perspective view showing prior art female terminal parts.
Figure 2A:
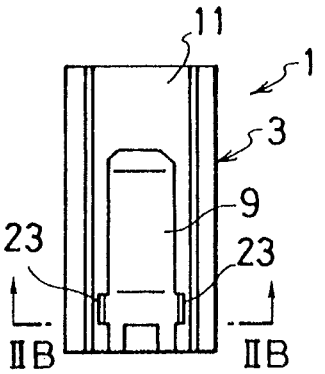
FIG. 2A PRIOR ART
FIG. 2A is a plane view showing an assembly step of the prior art female terminal parts, in which the plate spring piece is not yet assembled.
Figure 2B:
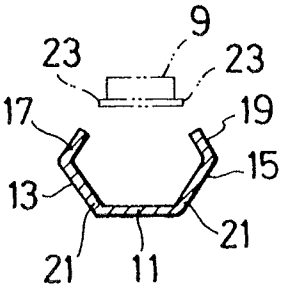
FIG. 2B PRIOR ART
FIG. 2B is a cross-sectional view taken along the line b—b in FIG. 2A.
Figure 2C:
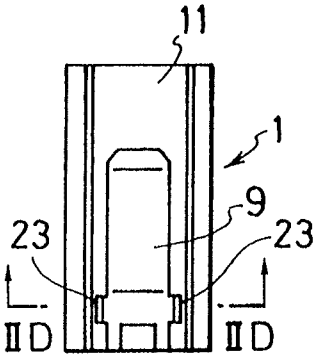
FIG. 2C PRIOR ART
FIG. 2C is a plane view showing an assembly step of the prior art female terminal parts, in which the plate spring piece is mounted within the terminal body.
Figure 2D:
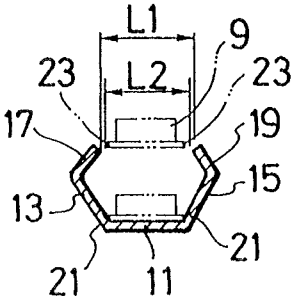
FIG. 2D PRIOR ART
FIG. 2D is a cross-sectional view taken along the line d—d in FIG. 2C.
Figure 2E:
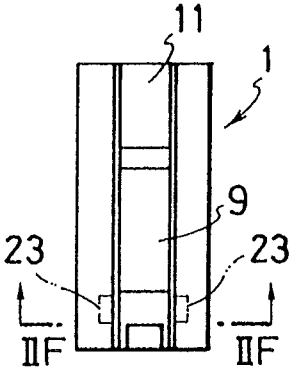
FIG. 2E PRIOR ART
FIG. 2E is a plane view showing an assembly step of the prior art female terminal parts, in which the two side plate portions are bent inward.
Figure 2F:
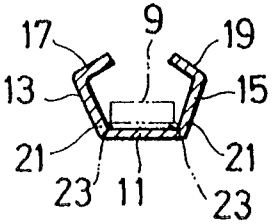
FIG. 2F PRIOR ART
FIG. 2F is a cross-sectional view taken along the line f—f in FIG. 2E.
Figure 2G:
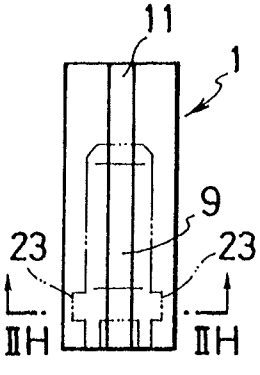
FIG. 2G PRIOR ART
FIG. 2G is a plane view showing an assembly step of the prior art female terminal parts, in which the two side plate portions and the two half top plate portions are both further bent inward.
Figure 2H:
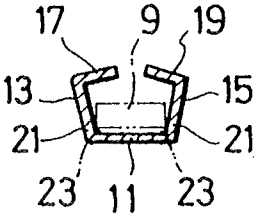
FIG. 2H PRIOR ART
FIG. 2H is a cross-sectional view taken along the line h—h in FIG. 2G.
Figure 2I:
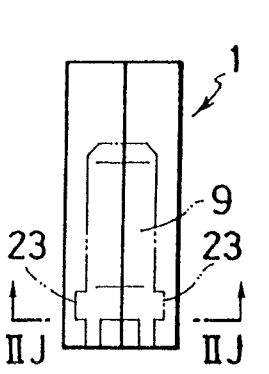
FIG. 2I PRIOR ART
FIG. 2I is a plane view showing an assembly step of the prior art female terminal parts, in which the two side plate portions and the two half top plate portions are bent completely inward.
Figure 2J:
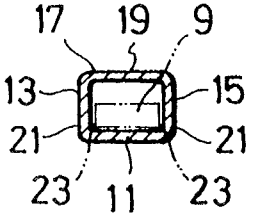
FIG. 2J PRIOR ART
FIG. 2J is a cross-sectional view taken along the line j—j in FIG. 2I.
Figure 3A:
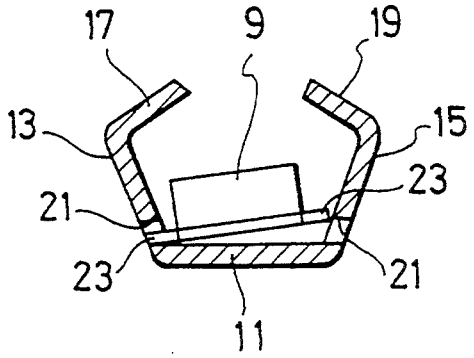
FIG. 3A PRIOR ART
FIGS. 3A and 3B are cross-sectional views for assistance in explaining the state where the plate spring piece is dislocated from the lug engagement holes under condition that the two side plate portions are opened or half closed.
Figure 3B:
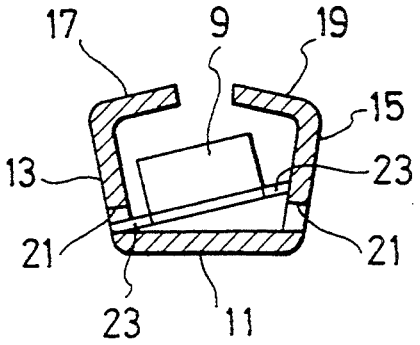
FIG. 3B PRIOR ART

Being different from the prior art female terminal parts 1 shown in FIG. 1, the feature of this embodiment is that the two opposing cut-off end surfaces **27*a* and 29*a* of the two half top plate portions 27 and 29 are both chamfered from the inner side of the square electric contact portion 3**.

Figure 7:
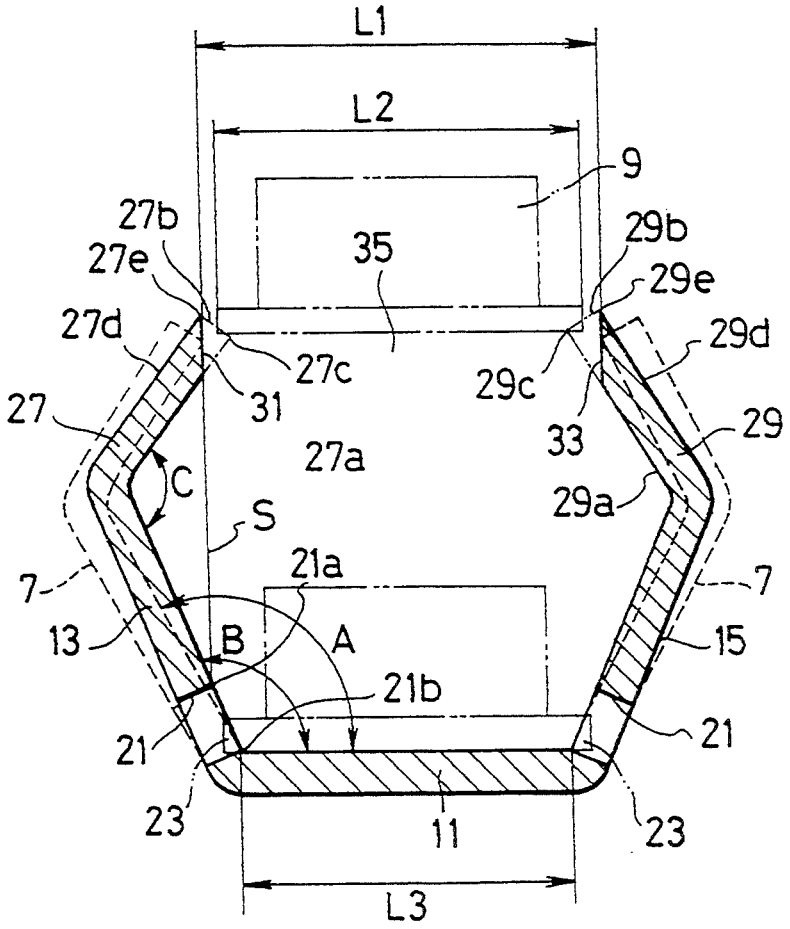
FIG. 7 is a cross-sectional views for assistance in explaining the dimensional relationship between the terminal body and the plate spring piece.

In more detail, with reference to FIG. 7, an inner ridgeline **27*c* formed between an inner side surface 27*a* and an upper cut-off surface 27*b* of the half top plate portion 27 is chamfered so as to form a chamber surface 31 extending from a ridgeline 27*e* formed between an outer side surface 27*d* and the upper cut-off surface 27*b* to an uppermost edge 21*a* of the lug engagement hole 21 in the direction roughly perpendicular to the bottom plate portion 11. In the same way, an inner ridgeline 29***c* formed between an inner side surface 29*a* and an upper cut-off surface 29*b* of the half top plate portion 29 is chamfered so as to form a chamber surface 33 extending from a ridgeline 29*e* formed between an outer side surface 29*d* and the upper cut-off surface 29*b* to an uppermost edge 21*a* of the lug engagement hole 21 in the direction roughly perpendicular to the bottom plate portion 11.

A pair of these two chamfered surfaces 31 and 33 form an opening 35, through which the plate spring piece 9 is passed and mounted on the bottom plate portion 11 of the terminal body 28, when assembled. In more detail, in order that the plate spring piece 9 can be passed through the opening 35 between the two half top plate portions 27 and 29, the distance L1 of the opening 35 between the two chambered surfaces 31 and 33 must be slightly larger than the width L2 of the plate spring piece 9, that is, the distance L2 between the two outer ends of the lug portions 23. On the other hand, in order to securely engage the two lug portions 23 with the two lug engagement holes 21 after the plate spring piece 9 has been mounted on the bottom plate portion 11 of the terminal body 28, it is preferable that the distance L3 between the two lowermost ends 21*b* of the two lug engagement holes 21 is smaller than the distance L2 between the two side ends of the lug portions 23, and in addition the distance between the two uppermost edges 21*a* of the two lug engagement holes 21 is slightly larger than the distance L2. As a result, it is most preferable to form the two chamfered surfaces 31 and 33 in such a way as to be located in a plane S extending from the outer ridgelines 27*e* and 29*e* to the uppermost edges 21*a* of the lug engagement holes 21, respectively.

In this embodiment, since the two opposing inner cut-off end surfaces 27*b* and 29*b* of the two half top plate portions 27 and 29 are both chamfered, it is possible to widen the opening 35 between the two half top plate portions 27 and 29, while reducing the distance between the two opposing uppermost edges 21*a* of the two lug engagement holes 21. In other words, an angle B between the bottom plate portion 11 and the side plate portion 13 of the terminal body 28 of the present invention (solid lines) can be reduced smaller than an angle A between the bottom plate portion 11 and the side plate portion 13 of the prior art terminal body 7 (dashed lines), so that the distance L1 between the two opposing uppermost edges 21*a* of the two lug engagement holes 21 can be reduced to that extent. Accordingly, since the engagement rate between the lug portions 23 of the plate spring pieces 9 with the lug engagement holes 21 can be increased at the uppermost edges 21*a* of the lug engage holes 21, even if an external force is applied to the terminal body 28 and thereby the terminal body 28 is vibrated, for instance, it is possible to prevent the plate spring pieces 9 from being dislocated from the lug engage holes 21, that is, to maintain the plate spring piece 9 securely at the normal position within the terminal body 28.

In this connection, when the angle C (see FIG. 7) between the side plate portion 13 or 15 and the half top plate portion 27 or 29 is simply increased, without changing the angle B and without chamfering the cut-off end surface 27*b* or 29*b*, another problem may arises in that the number of bending steps must be increased or the bending precision deteriorates.

Further, the chambered surfaces 31 and 33 can be formed by grinding the two opposing cut-off end surfaces 27*b* and 29*b* with the use of a grinder with a thickness L1, before the terminal bodies 28 are assembled with the plate spring piece 9.

In assembly of the terminal parts 25 of the present invention along an automatic assembly line, a plurality of terminal bodies 28 connected to a chain band 37 and a plurality of plate spring pieces 9 connected another chain band 39 are arranged being crossed with each other and then bent in sequence to complete the female terminal parts 25, as shown in FIG. 5.

Figure 6A:
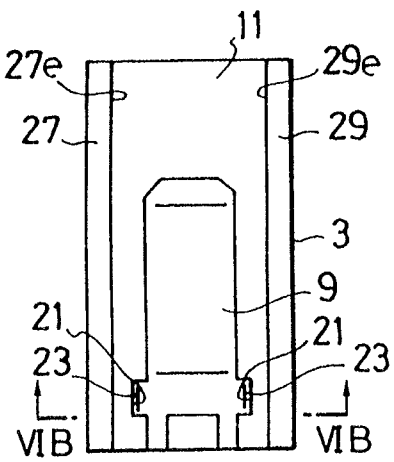
FIG. 6A is a plane view showing an assembly step of the female terminal parts of the present invention, in which the plate spring piece is located over the terminal body.
Figure 6B:
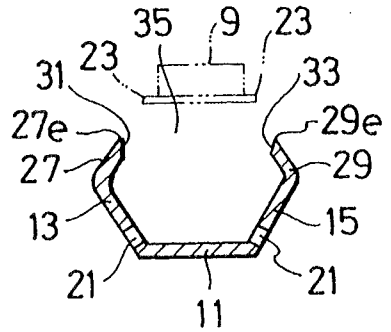
FIG. 6B is a cross-sectional view taken along the line b—b in FIG. 6A.
Figure 6C:
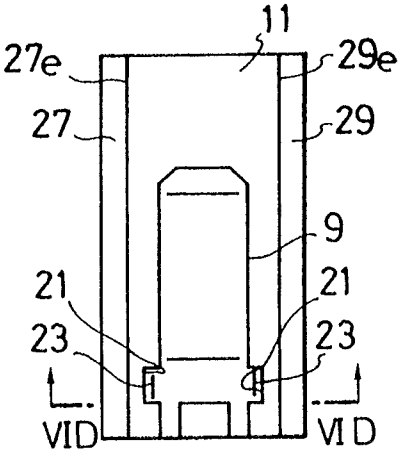
FIG. 6C is a plane view showing an assembly step of the female terminal parts of the present invention, in which the plate spring piece is mounted within the terminal body.
Figure 6D:
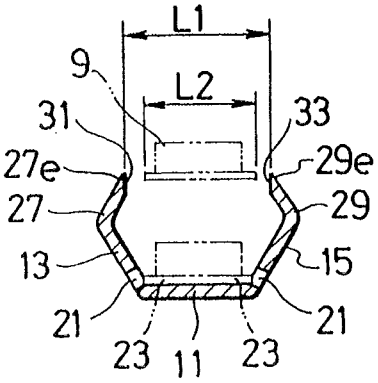
FIG. 6D is a cross-sectional view taken along the line d—d in FIG. 6C.
Figure 6E:
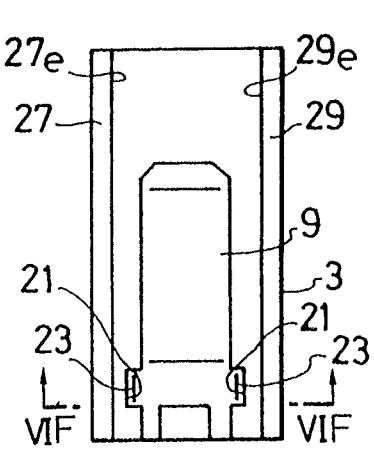
FIG. 6E is a plane view showing an assembly step of the female terminal parts of the present invention, in which the two side plate portions are bent inward.
Figure 6F:
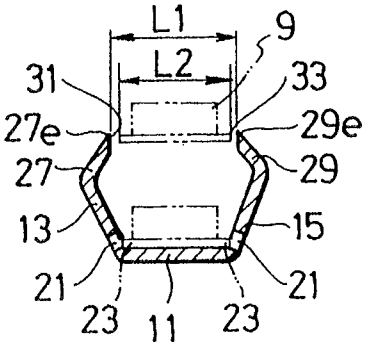
FIG. 6F is a cross-sectional view taken along the line f—f in FIG. 6E.
Figure 6G:
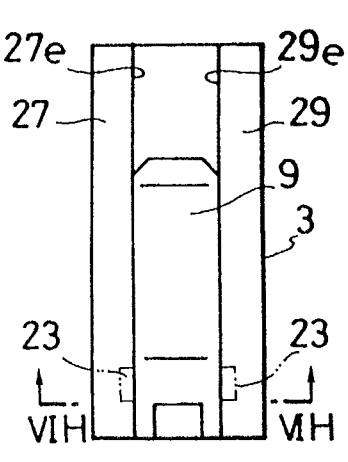
FIG. 6G is a plane view showing an assembly step of the female terminal parts of the present invention, in which the two side plate portions are both further bent inward.
Figure 6H:
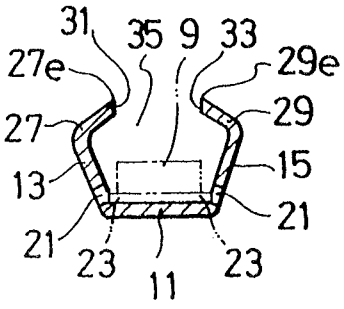
FIG. 6H is a cross-sectional view taken along the line h—h in FIG. 6G.

In more detail, in the first step as shown in FIGS. 6A to 6B, the plate spring piece 9 connected to the chain band 39 is located over the terminal body 28 and then the two side plate portions 13 and 15 are slightly bend inward by use of a first bending jig. In the second step as shown in FIGS. 6C and 6D, the plate spring piece 9 is lowered passing through the opening L1 (as already explained) between the two chamfered surfaces 31 and 33 to mount the plate spring piece 9 onto the bottom plate portion 11. Further, the two side plate portions 13 and 15 are slightly further bend inward by use of a second bending jig. In the third step as shown in FIGS. 6E and 6F, the two side plate portions 13 and 15 are slightly further bend inward by use of a third bending jig. In the fourth step as shown in FIGS. 6G and 6H, the two side plate portions 13 and 15 are slightly further bend inward by use of a fourth bending jig. In this step, since the two lug portions 23 can be engaged with the two lug engagement holes 21 completely, the plate spring piece 9 is separated from the chain band 39 by cutting off a connecting piece 39A (see FIG. 4) by inserting a cutting jig through the opening formed between the two chamfered surfaces 27*a* and 29*a* as shown in FIG. 6H. Thereafter, although not shown, the two side plate portions 13 and 15 and the two half top plate portions 27 and 19 are further bent simultaneously by the other bending jig. Further, after the terminal body 28 is completely bent as shown in FIG. 5, the terminal body 28 is separated from the chain band 37 by cutting off a connecting piece 37A (see FIG. 4). Further, as understood in FIG. 4, when the terminal bodies 28 are fed one by one in a first direction, the plate spring pieces 9 are fed one by one in a second direction perpendicular to the first direction.

As described above, in the female terminal parts according to the present invention, since the two opposing cut-off end surfaces 27*b* and 29*b* of the two half top plate portions 27 and 29 are chamfered, it is possible to reduce the distance (L1) between the two uppermost edges 21*a* of the two lug engagement holes 21, without reducing the upper opening distance L1 between the two half top plate portions, so that the lug portions 23 of the plate spring piece 9 can be firmly engaged with the lug engagement holes 21 during the sequential bending steps, with the result that it is possible to prevent the plate spring piece 9 from being dislocated from the lug engagement holes 21 due to external force or vibration.

What is claimed is:

1. An electrical connector including a group of female terminal parts, comprising:

a terminal body formed with:

a wire connecting portion; and an electric contact portion, having:

a bottom plate portion having two sides;

a pair of opposing side plate portions extending upward from both sides of the bottom plate portion and further outward away from each other, two lug engagement holes being formed on both of the side plate portions, respectively; and a pair of opposing top plate half portions extending upward from upper ends of the side plate portions and further inward toward each other and terminating in respective cut-off end surfaces, the top plate portions having a chamfered surface at a ridgeline formed between an inside surfaces and the cut-off end surface; and a plate spring piece formed with:

a spring body; and a pair of lug portions engaged with the lug engagement holes formed in the two side plate portions, respectively when assembled with the terminal body, a distance between two outer ends of the lug portions being determined slightly smaller than a distance between the two chamfered surfaces of the two top plate half portions.

2. The female terminal parts of claim 1, wherein each of the chamfered surfaces is a slope surface beginning inward from an outer ridgeline formed between an outside surface and the cut-off end surface of each of the top plate portions.

3. The female terminal parts of claim 2, wherein each of the chamfered surfaces is located in a plane extending from the outer ridgeline to an uppermost edge of the lug engagement hole.

4. The female terminal parts of claim 1, wherein the lug engagement holes are formed on the two side plate portions beginning from the bottom plate portions, respectively.

5. The female terminal parts of claim 1, wherein the two opposing cut-off end surfaces of the two half top plate portions are chamfered by abrading before the female terminal parts are assembled with each other.

* * * * *